US007086759B2

(12) United States Patent
Hartmann, Jr. et al.

(10) Patent No.: US 7,086,759 B2
(45) Date of Patent: Aug. 8, 2006

(54) DECORATIVE LAMP

(75) Inventors: Richard Hartmann, Jr., Holland, MI (US); Richard J. Camarota, Holland, MI (US)

(73) Assignee: ITC Incorporated, Holland, MI (US)

( * ) Notice: Subject to any disclaimer, the term of this patent is extended or adjusted under 35 U.S.C. 154(b) by 127 days.

(21) Appl. No.: 10/799,830

(22) Filed: Mar. 12, 2004

(65) Prior Publication Data

US 2005/0201106 A1 Sep. 15, 2005

(51) Int. Cl.
*F21V 3/00* (2006.01)

(52) U.S. Cl. ..... 362/311; 362/332; 362/455

(58) Field of Classification Search ..... 362/427, 362/311, 307, 455, 410, 414, 332
See application file for complete search history.

(56) References Cited

U.S. PATENT DOCUMENTS 6,312,145 B1 * 11/2001 Rhoad ..... 362/311
6,471,368 B1 * 10/2002 Lin ..... 362/216
6,619,829 B1 * 9/2003 Chen ..... 362/544
6,713,961 B1 * 3/2004 Honda et al. ..... 313/607
2005/0162860 A1 * 7/2005 Su ..... 362/512

OTHER PUBLICATIONS

Catalog: © 2002 ITC Incorporated, front and back covers and p. 6 showing as examples models No. 81907-NI and 81922-CH/BR (3 sheets).

* cited by examiner

*Primary Examiner*—Renee Luebke
*Assistant Examiner*—Zahra I. Bennett
(74) *Attorney, Agent, or Firm*—Flynn, Thiel, Boutell & Tanis, P.C.

(57) ABSTRACT

A lamp includes a housing for a light emitter, e.g. a halogen bulb. The housing has a primary light outlet adjacent its forward end, and a peripheral wall having a plurality of secondary light-emitting openings. A light transmitting ring fixed on the housing has fingers covering the second openings. A retaining ring fixes a lens at the primary opening and to the light transmitting ring.

27 Claims, 13 Drawing Sheets

DECORATIVE LAMP

FIELD OF THE INVENTION

The present invention relates to lamps and, more specifically, to decorative lamps.

BACKGROUND OF THE INVENTION

Consumers typically select a specific lamp based on function (e.g. light distribution or pattern, light emitter type, etc.) and for an aesthetically pleasing appearance.

Wall or ceiling mountable reading lamps of various types are known. One popular lamp type fixes an incandescent or halogen bulb in a housing having an open end through which the bulb emits light, e.g. for reading, task lighting, or even area lighting.

In such incandescent lamps, the housing open end is typically physically open to ventilate air flow, for placing a burned-out incandescent bulb, and for light emission. Indeed, in one such lamp marketed by the Assignee of the present invention, the peripheral wall of the housing, adjacent the open end, is pierced by circumferentially spaced and elongated slots, which provide an aesthetically pleasing appearance, a glow from light reflected from the opposite side of the inner face of the housing, and additional ventilation through the housing.

However, in contrast to common incandescent bulbs, a halogen bulb's packaging may warn the user: (1) avoid use close to combustible materials to avoid possibility of fire, (2) to avoid skin burns wait for bulb to cool before handling, (3) do not touch the cool bulb with the bare hands, or if touched wipe fingerprints remaining on the halogen bulb's glass envelope with alcohol before lighting, (4) do not stare at the operating bulb to avoid the risk of serious eye injury, and (5) do not move the lamp during operation because mechanical shock can cause shattering of the bulb. Thus, typically, for reasons of safety, the open end of a halogen lamp housing is normally covered by a frosted, protective, heat resistant, light transmitting lens, typically a sturdy, relatively thick glass lens, and a housing peripheral wall that is non-perforate. This disadvantageously limits the range of aesthetically pleasing appearance effects available to manufacturers of halogen lamps.

Accordingly, the objects and purposes of this invention include overcoming disadvantages of prior known lamps, such as those discussed above.

SUMMARY OF THE INVENTION

The present invention comprises lamp apparatus, wherein a hollow housing, with a light transmitting lens, is adapted to safely enclose even a relatively fragile light emitter, such as a halogen bulb, while allowing the housing to have additional areas located therein to achieve any of a number of aesthetically pleasing, light emitting patterns.

DETAILED DESCRIPTION

Figure 1:
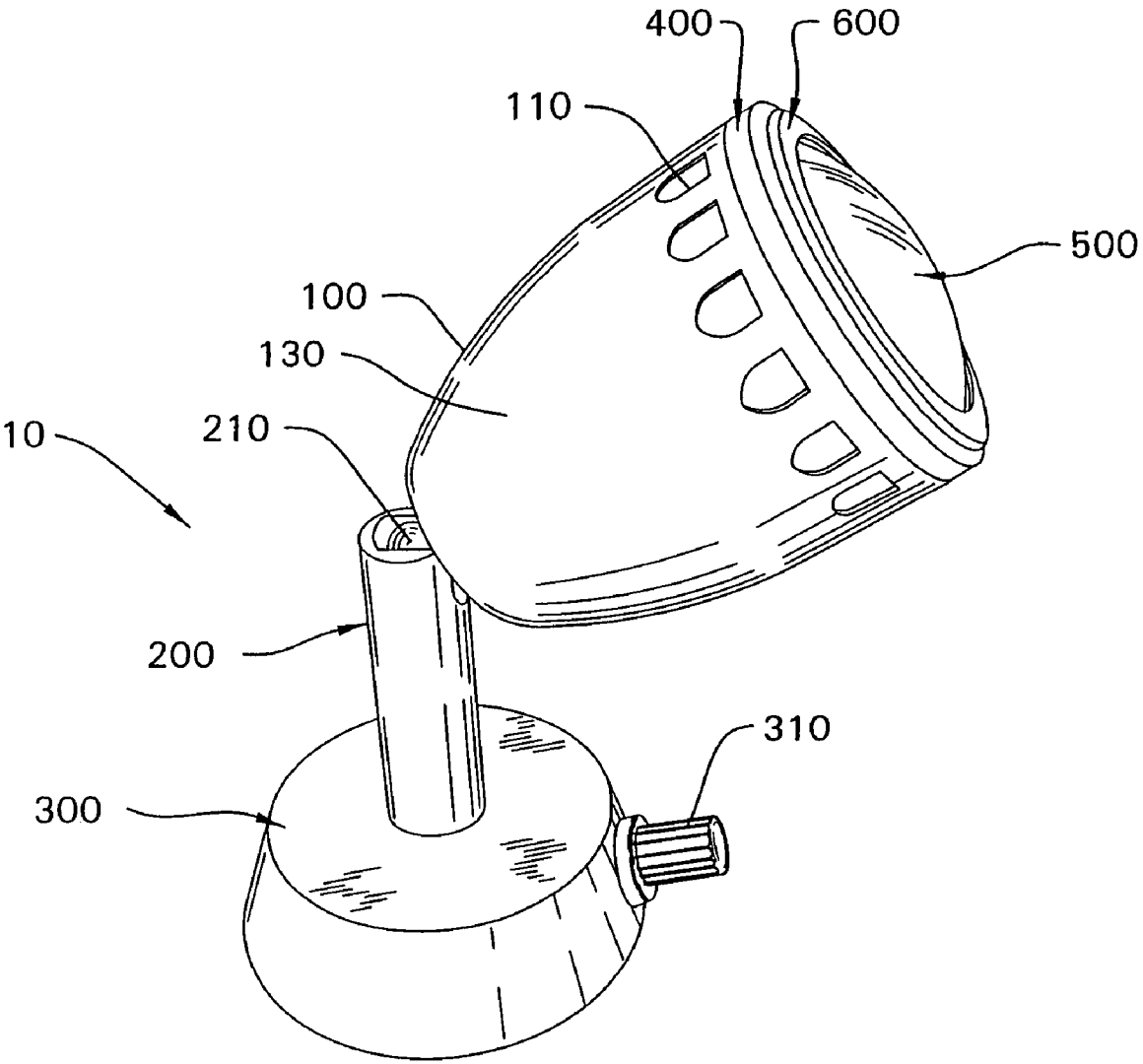
FIG. 1 is a pictorial view of a lamp according to an embodiment of the present invention.

FIG. 1 shows a lamp 10 embodying the present invention. The lamp 10 comprises a base 300 conventionally fixedly mounted by any convenient means, not shown, on a desired surface, typically on a wall or ceiling, e.g. in a dwelling, motorhome or boat cabin. An elongate support shaft 200 has one end mounted on the base 300. A housing 100 may be fixed, but preferably is adjustably pivotably mounted, as by a conventional pivot structure generally indicated at 210 in FIG. 1, on the free end of the support shaft 200, thereby allowing the housing 100 to be tilted ("pitched") through a range of angles with respect to the support shaft 200 and to hold at a desired angle, as by friction.

The support shaft 200 may be conventionally fixed to the base 300, in a manner not shown, either immovably, or movably, e.g. such that the support shaft 200 is rotatable about its length axis (i.e. can "roll") with respect to the base 300. The base 300 may be of any desired shape, e.g. a frustoconical shape as in FIG. 1 or a generally rectangular shape as at 300A in FIG. 2. The shaft 200 may be located as desired on the base, e.g. centered as at 300 in FIG. 1 or off-center as at 300A in FIG. 2. Thus, the housing 100 may be swivelly (roll and pitch) fixed to the base 300, for convenient aiming of the remote end of the housing 100 at an area to be illuminated.

Figure 4:
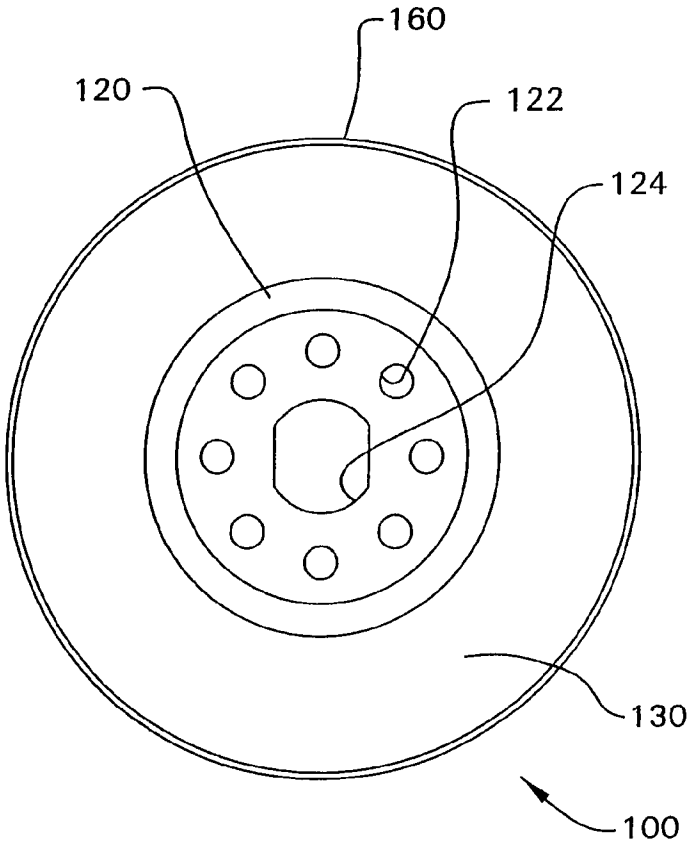
FIG. 4 is an end view of the housing of FIG. 3.

The housing 100 (FIGS. 2–4) generally comprises a cup-like sleeve having a peripheral wall 130, an end wall 120, and an open end bounded by a rim 160. The peripheral wall 130 may be shaped as desired, preferably widening toward the rim 160, e.g. of a generally cylindrical, conical, stepped, or curved profile, as in the generally tulip-shape here shown. The end wall 120 may be integral with the peripheral wall 130, or a separate base plate fixed thereto. The end wall 120 (FIG. 4) of the housing 100 includes a central mounting hole 124 for conventional, fixed connection at the free end of the support shaft 200 (here by means of the pivot 210). A plurality of ventilation holes 122 in the end wall 120 enhances the flow of cooling air between the interior and exterior of the housing.

Within the housing 100 a conventional riser, indicated schematically at 760 (FIG. 2), fixedly and coaxially extends from the end wall 120 part way toward the open end bounded by the rim 160. A reflector 700 (FIG. 2) has a light emitter mount 710 disposed in the inboard end portion thereof, and is fixed coaxially on the free end portion of the riser 760. The mount 710 is conventionally configured to receive a compact, hot running, light emitter 800, such as a conventional halogen bulb, having a glass, light transmitting envelope 810. The riser 760 here routes insulated electrical conductors 770 to the light emitter mount, or socket, 710 through the mounting hole 124 and through conventional, longitudinal passages, not shown, in the pivot 210, shaft 200, and base 300 to exit from the latter at 771 for connecting to a suitable voltage source, as at V in FIG. 2A. A conventional switch, or dimmer switch, SW, here hidden in the housing, may be interposed in one of the conductors 770 to turn on and off and/or dim the light emitter 800 in a conventional manner, and carries a conventional, manually actuable knob 310, 310A or the like to actuate the switch SW.

Figures 2, 2A:
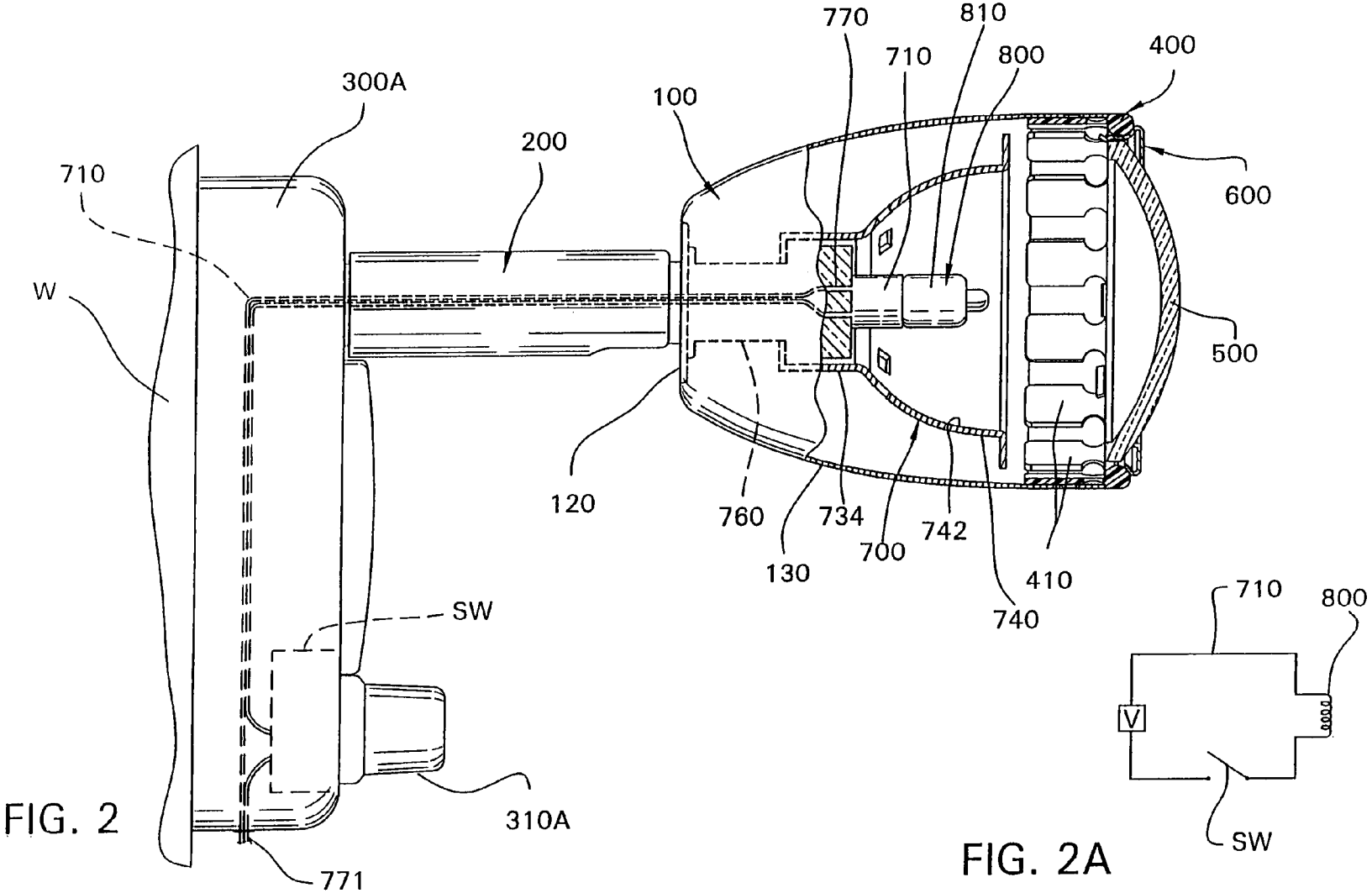
FIG. 2 is a partially broken, side elevational view of the lamp of FIG. 1.
FIG. 2A is a schematic view of circuitry associated with the lamp of FIG. 1.
Figure 3:
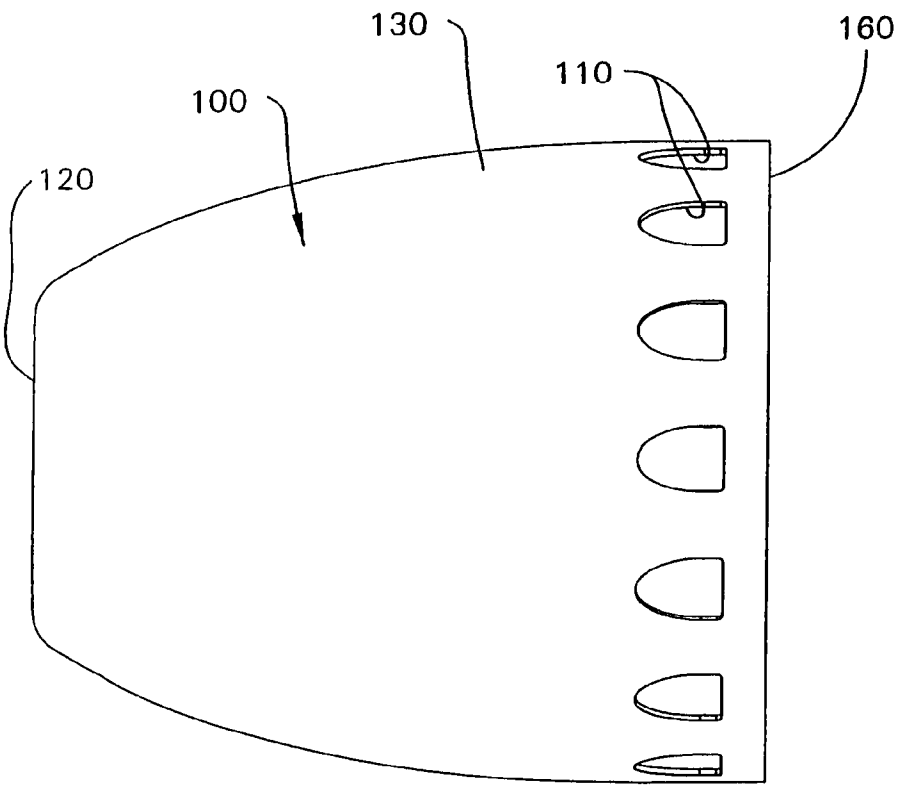
FIG. 3 is an enlarged side elevational view of the housing of the lamp of FIG. 1.
Figure 6:
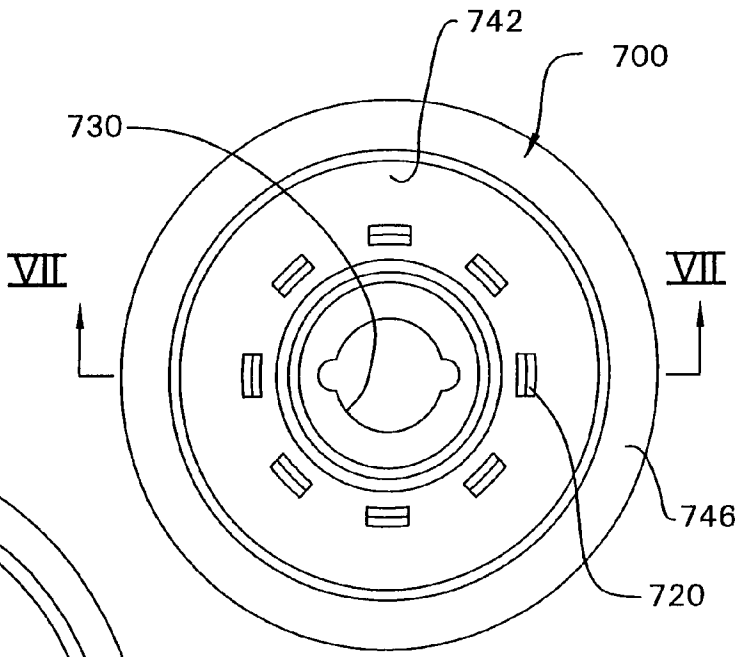
FIG. 6 is a front elevational view of the reflector of FIG. 5.
Figure 5:
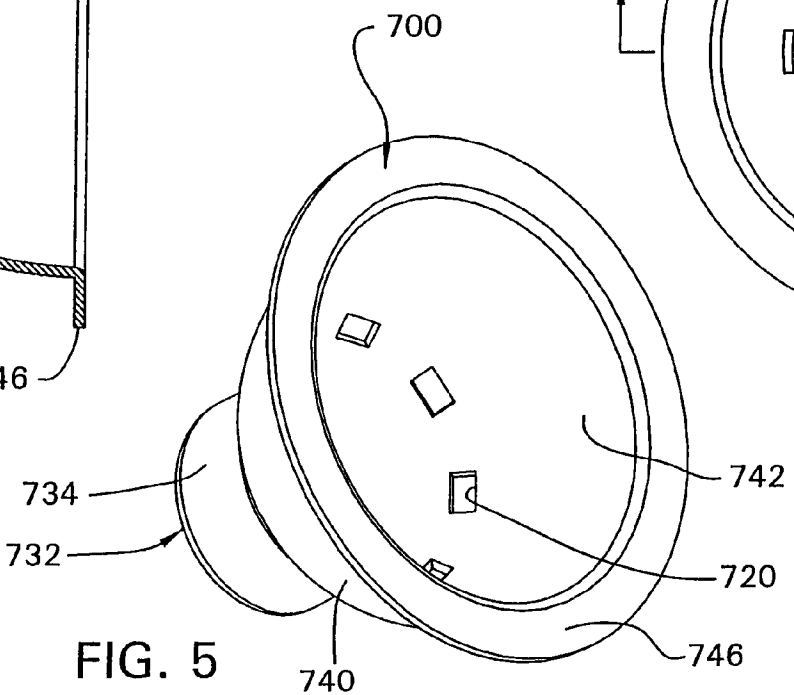
FIG. 5 is an enlarged pictorial view of the reflector of the lamp of FIG. 1.
Figure 7:
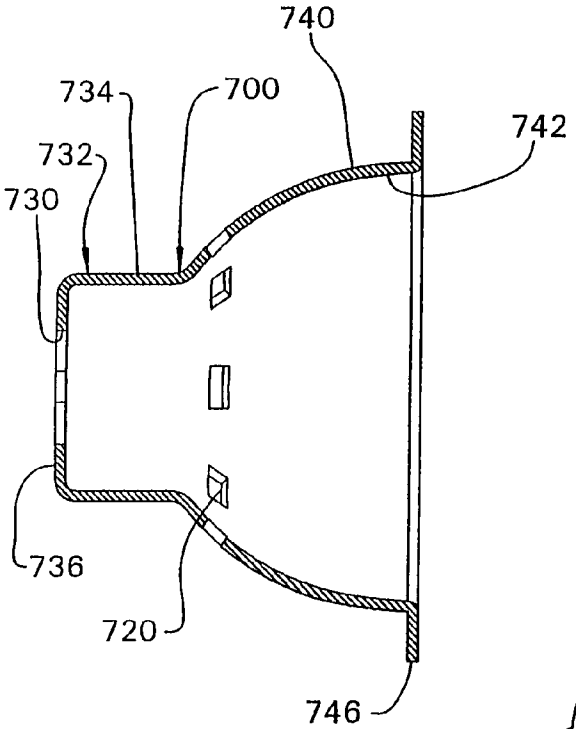
FIG. 7 is a central cross sectional view substantially taken on the line V—V of FIG. 6.
Figure 9:
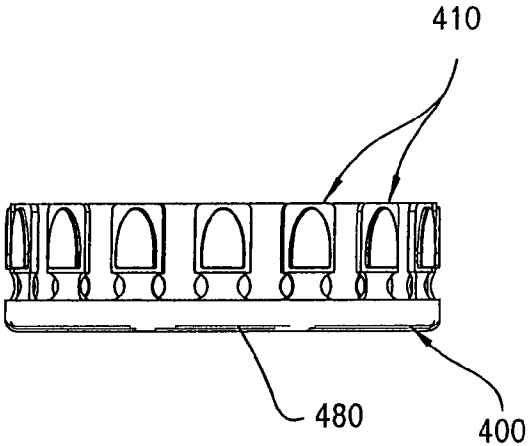
FIG. 9 is a side elevational view of the highlight ring of FIG. 8.
Figure 8:
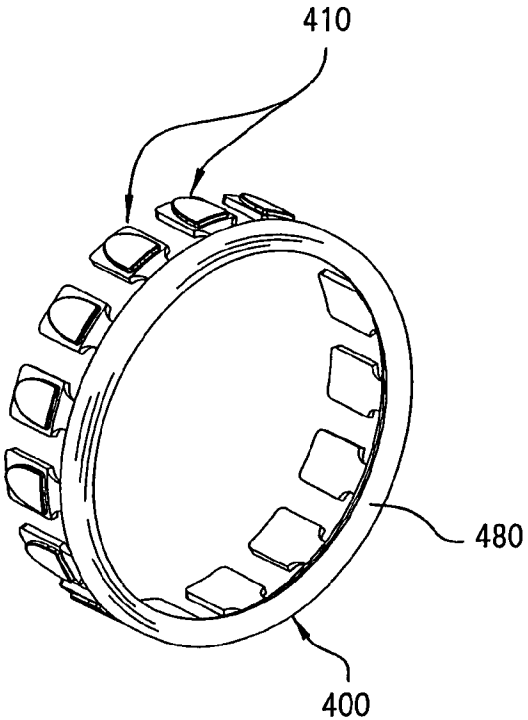
FIG. 8 is an enlarged pictorial view of the highlight ring of the lamp of FIG. 1.

The reflector 700 (FIGS. 2 and 5–7) here shown is generally funnel shaped, with a generally cylindrical, cup-like base 732 having a peripheral wall 734 and an inboard end wall 736, and defining the inboard portion of the reflector 700. The outboard portion of the reflector 700 comprises a radially outwardly flaring, preferably generally parabolically shaped, peripheral wall 740 having a light reflecting interior surface 742 coaxially surrounding the light emitter 800 and a radially outward extending, outboard end flange 746. The peripheral wall 740 includes a plurality of vent holes 720 to permit cooling air flow axially through the reflector 700 and past the light emitter 800 (FIGS. 2 and 7). A bulb mount opening 730 in the inboard end wall 736 of the reflector fixedly receives the bulb mount 710. The base 732 of the reflector 700 coaxially contains the bulb mount 710.

Figure 14:
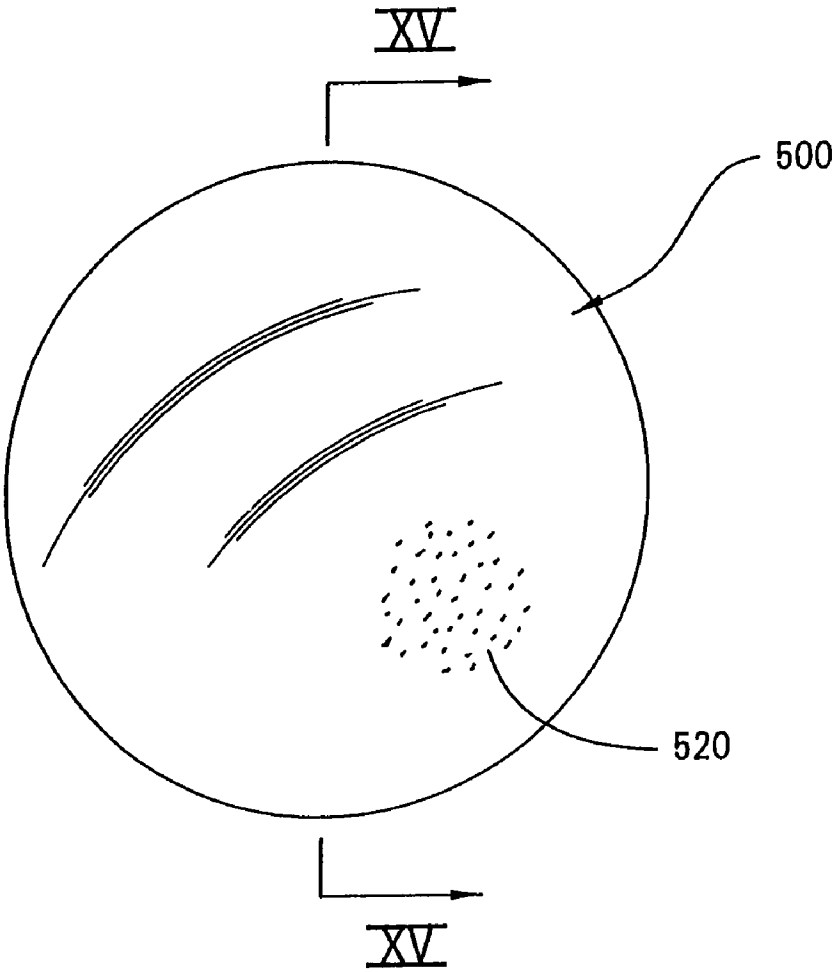
FIG. 14 is an enlarged front view of the lens of FIG. 13.
Figure 15:
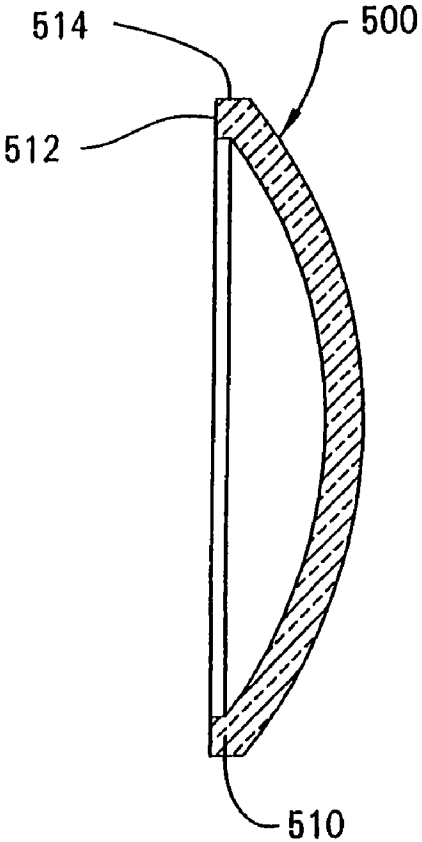
FIG. 15 is a central cross sectional view substantially taken on the line XV—XV of FIG. 14.
Figure 16:
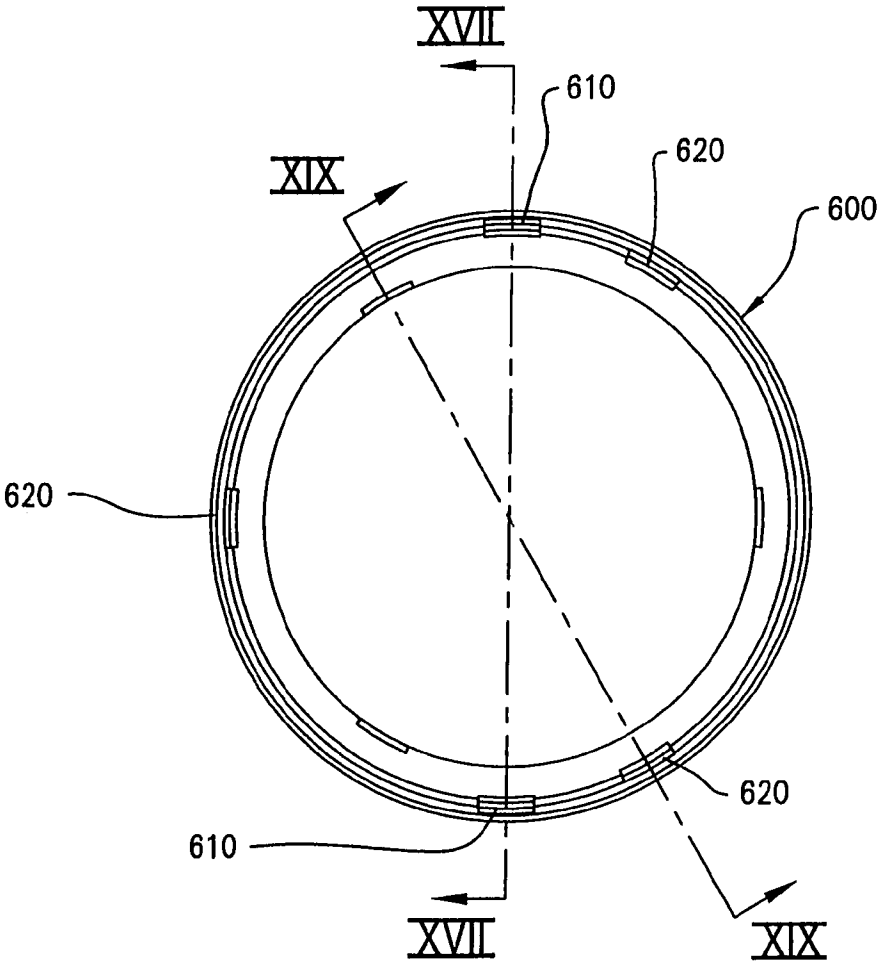
FIG. 16 is an enlarged rear view of the lens retaining ring of FIG. 1.
Figure 19:
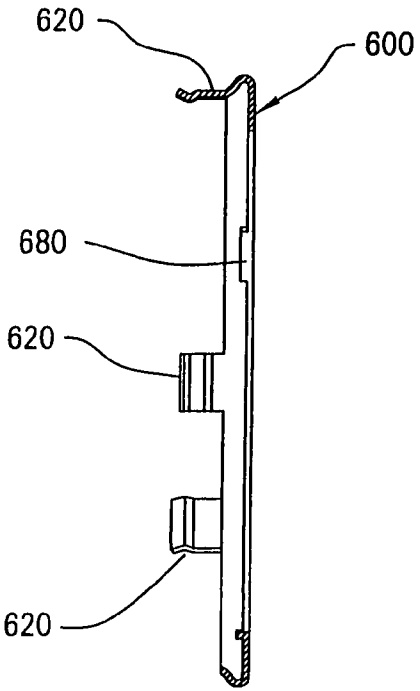
FIG. 19 is a cross sectional view substantially taken on the line XIX—XIX of FIG. 16.
Figure 18:
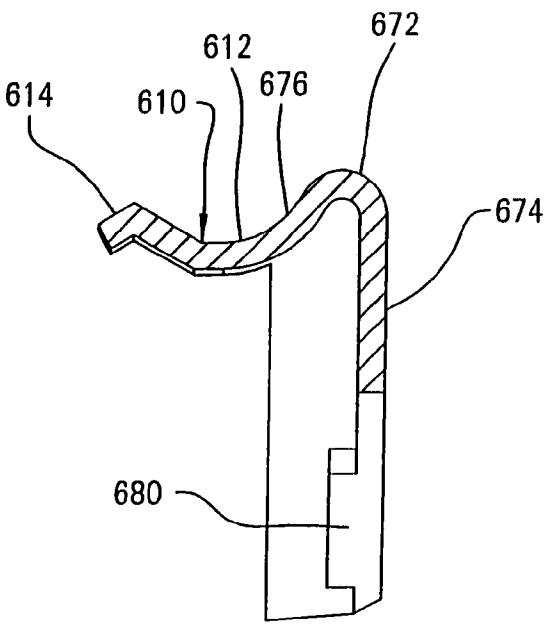
FIG. 18 is an enlarged fragment of FIG. 17.
Figure 20:
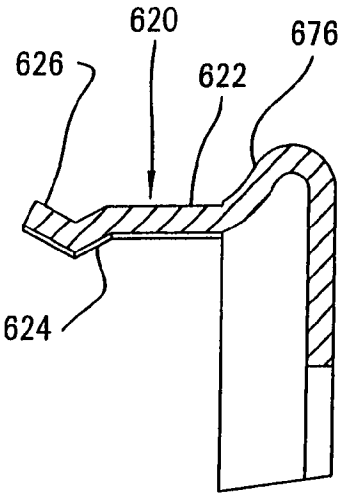
FIG. 20 is an enlarged fragment of FIG. 19.
Figure 17:
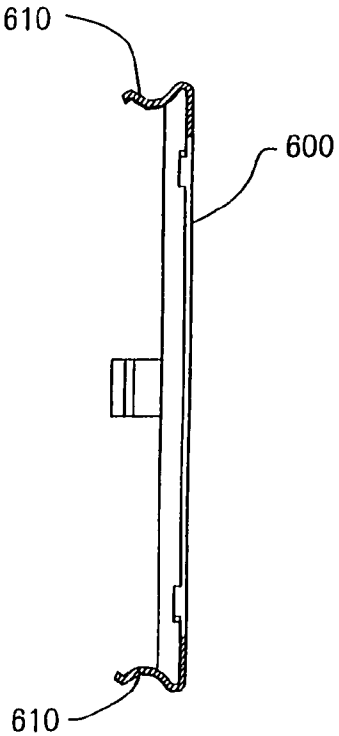
FIG. 17 is a central cross sectional view substantially taken on the line XVII—XVII of FIG. 16.

The lamp 10 (FIGS. 1 and 2) further includes a lens 500 that is to be removably fixed with respect to the open end of the housing 100 by a retaining ring 600. The lens 500 (FIGS. 14 and 15) here is an outwardly convexly curved, heat resistant glass element with a light diffusing surface. The rim 510 of the lens 500 here has flat, axially inward and radially outward faces 512 and 514, respectively. The light diffusing surface may be of any desired kind, e.g. frosted as schematically indicated at 520 in FIG. 14.

Thus, with the lamp 10 turned on, light from the light emitter 800 (1) radiates forward, and (2) reflects from the reflective wall 742 forward, toward the open end of the housing 100, defined by the rim 160.

To the extent above discussed, the lamp 10 is substantially conventional and similar to known incandescent lamps and subassemblies of halogen lamps. Examples are models numbered 81907-NI and 81922-CH/BR, respectively, available from the Assignee of the present invention, ITC, Inc. located at 230 E. Lakewood Blvd., P.O. Box 8338, Holland, Mich. 49422 USA.

Turning now to aspects of the disclosed structure more closely relating to the present invention, the housing peripheral wall 130 (FIGS. 1 and 3) of the housing 100 includes a plurality of light-emitting, window-like, through openings 110. Conveniently, the openings 110 are even circumferentially spaced on the peripheral wall 130 in an annular array coaxial with the housing 100, and are all identically axially spaced from the rim 160 at the open end of the housing 100. Conveniently, the array of light-emitting openings 110 is, as in FIG. 3, closely axially spaced from the rim 160, though it is contemplated that the array may be located along the housing 100 further from the rim 160. The light emitting openings 110 may be of virtually any shape desired. However, in the embodiment shown in FIG. 3, each opening 110 has substantially the shape of a cut-off, or truncated, ellipse, which approximately repeats the shape of the housing peripheral wall 160, in an aesthetically pleasing manner. While less convenient, it is contemplated that the array may include a first opening 110 of a first shape and one or more subsequent openings 110 of shapes different from the first. For example, an alternating pattern of first and second shapes may be repeated circumferentially to form an array of light-emitting openings 110 encircling the housing 100. The openings 110 are sized, shaped, and spaced from each other and from the rim 160 so as not to reduce the structural integrity of the housing 100. While, in the FIG. 3 example, the width of the openings approximates the distance between them, and their spacing from the rim 160 is about half their axial length, variation of these relationships is contemplated.

Figure 10:
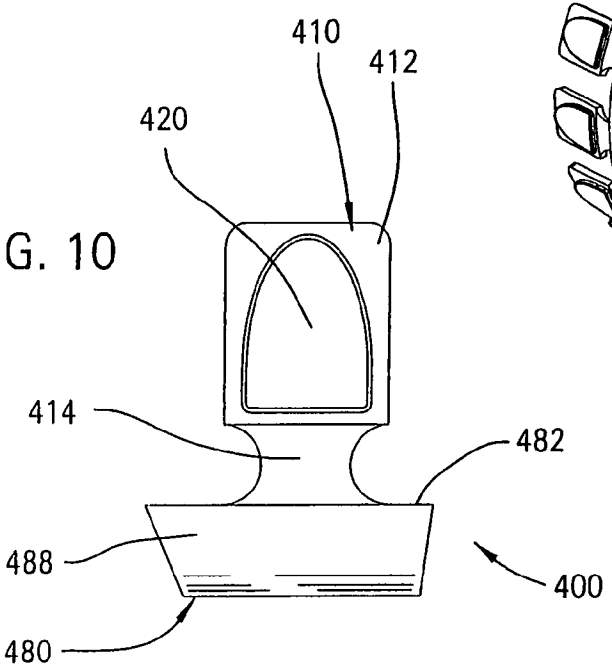
FIG. 10 is an enlarged fragment of the highlight ring of FIG. 8.
Figure 13:
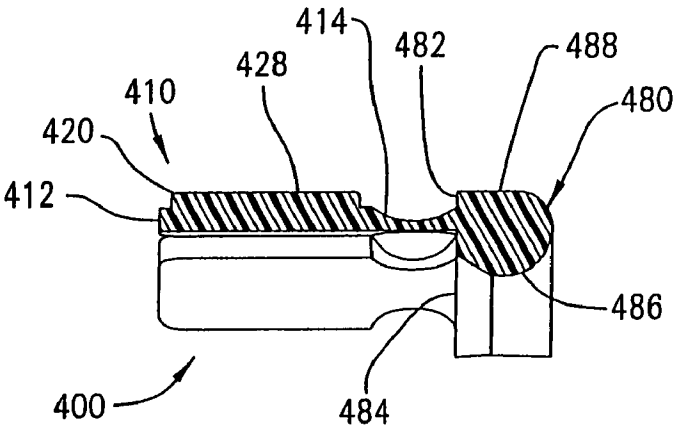
FIG. 13 is an enlarged fragment of FIG. 12.
Figure 12:
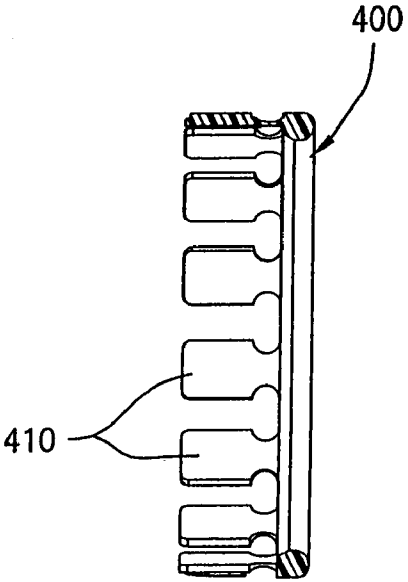
FIG. 12 is a cross sectional view substantially taken on the line XII—XII of FIG. 11.
Figure 11:
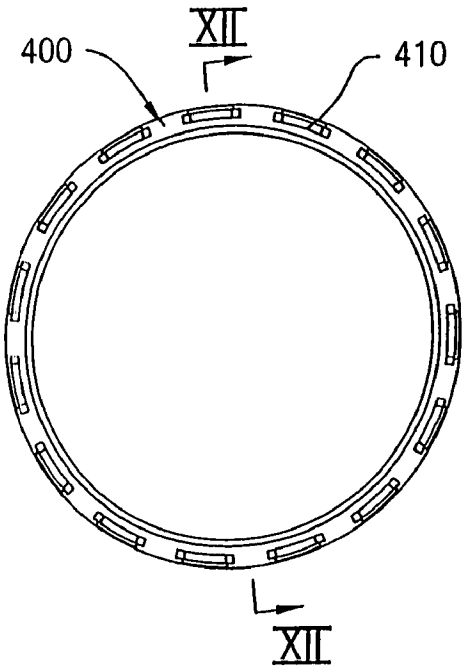
FIG. 11 is a rear elevational view of the highlight ring of FIG. 8.

A light-transmitting highlight ring 400 (FIGS. 8–13) includes an array of circumferentially spaced, side-by-side, resilient fingers 410 that fixedly and preferably integrally project substantially axially from one side of an annular base 480. The fingers 410 are resiliently bendable toward and away from the axis of the ring 400. The number and position of fingers 410 on the base 480 corresponds to the number and position of the light-emitting openings 110 in the peripheral wall 130 of the housing. Each finger 410 (FIGS. 10 and 13) includes a plate-like backer 412, gently curved circumferentially along a radius similar to that of the annular base 480, and here of generally rectangular outline, which connects through a neck 414 (which is radially and circumferentially narrowed to an elastically, radially bendable state) to the opposed side the annular base 480.

In cross section, the annular base 480 (FIG. 13) has axially inward facing steps 482 and 484 radially flanking the adjacent, axially outer end of the neck 414, a convexly rounded, radially inward face 486, and a preferably flat, radially outward face 488. The radially outward face 488 of the annular base 480 is axially aligned with, and extends radially outward somewhat beyond, the radially outward face 428 of a protrusion 420 that stands proud radially outward from the backer 412. The protrusion 420 is sized and shaped to fit snugly, but readily slidably removably, in a corresponding light-emitting opening 110 (FIG. 2) of the housing 100.

The highlight ring 400 is fixed in the open end of the housing 100 by inserting the resiliently sufficiently radially inward bent fingers 410 past the rim 160 and into the interior of the housing 100. Each finger 410 resiliently radially outwardly presses its protrusion 420 against the interior face of the peripheral wall 130 of the housing 100. Each finger 410 is axially aligned with a corresponding light-emitting opening 110. The finger 410 moves axially inward until it radially opposes, and its protrusion 420 aligns radially with, an opening 110, whereupon the protrusion radially outwardly snaps into the opening 110, in a circumferentially and axially fixed manner. With all of the protrusions 420 thus snap fitted into the corresponding light-emitting openings 110 in the housing 100, the step 482 of the annular base 480 is closely adjacent to, or seated against, the rim 160, as in FIGS. 1, 2, 21 and 22. Given that, the annular base 480 of the highlight ring 400 now extends out axially from the rim 160 of the housing 100, while the fingers 410 extend into the housing and lie resiliently against the interior face of the housing peripheral wall 130.

In the preferred embodiment shown, the retaining ring 600 (FIGS. 16–20) is formed of sheet material (preferably metal). The ring 600 has annular body 670 having a convexly rounded rim 672. A planar annular flange 674 extends radially inward from the front part of the rim 672. A radially and axially inward angled skirt 676 extends from the rear part of the rim 672.

Figure 22:
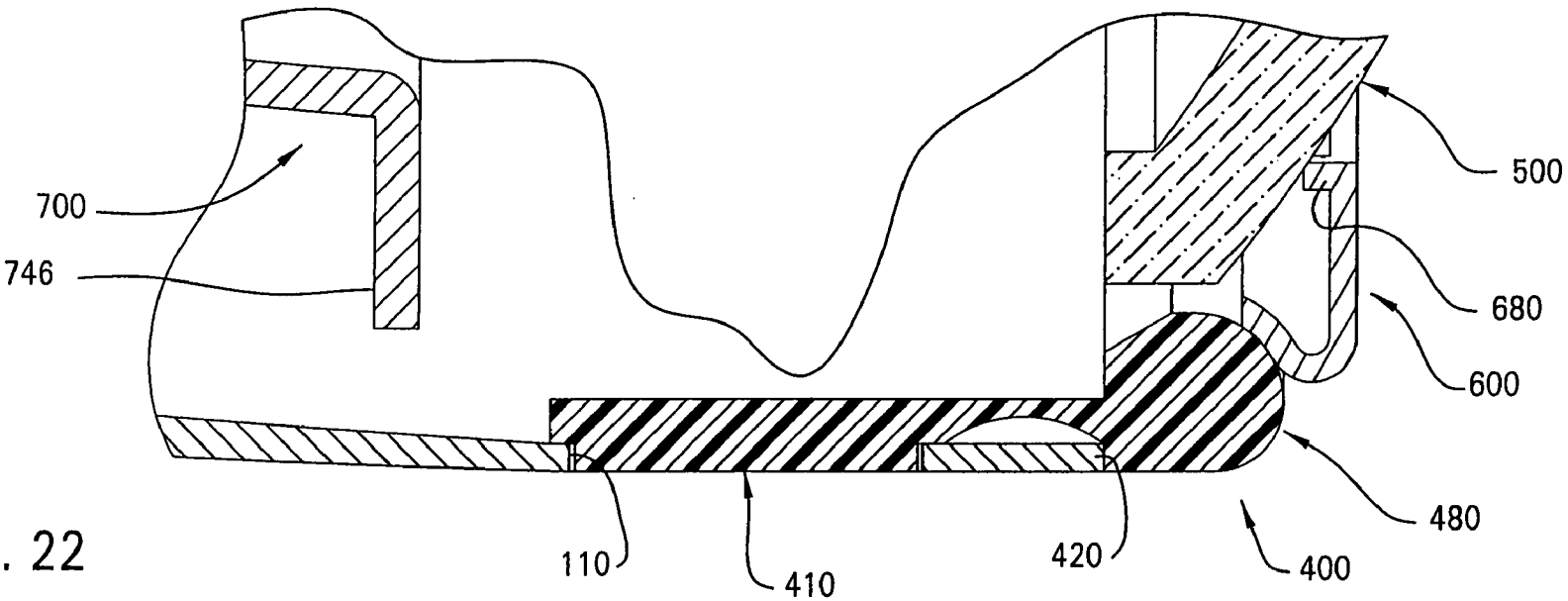
FIG. 22 is a further enlarged fragment of FIG. 2.

Plural (e.g. three) evenly circumferentially spaced, lens retaining ribs 680 (FIG. 18) protrude axially inward from the radially inboard edge of the flange 674 and are sized to engage the exterior face of the lens 500, as in FIG. 22, to positively block forward displacement of the lens.

Figure 23:
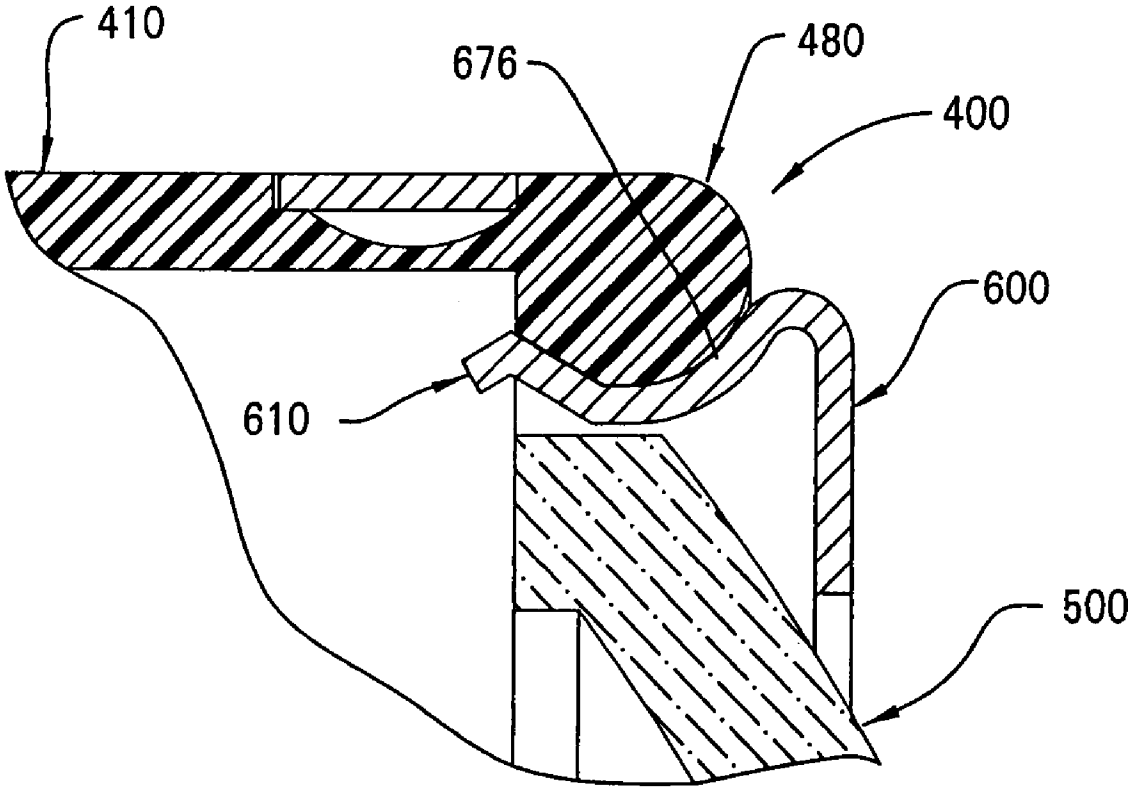
FIG. 23 is a view similar to FIG. 21 but taken generally on the line XVII—XVII of FIG. 16.

Plural (e.g. three) evenly circumferentially spaced, leaf-spring-like, highlight ring engaging, fingers (or clips) 610 (FIG. 18) extend axially inward (rearward) from the skirt 676. Each finger 610 comprises a radially outward concave portion 612 and a substantially shorter, radially and axially inwardly angled, deflector tip 614. The concave portion 612 is sized to resiliently press radially outward against and cup the convex, radially inner face 486 of the highlight ring 400, to resiliently fix the retaining ring 600 on the highlight ring 400 in a snap-fit manner, with the skirt 676 abutting the front of the highlight ring 400 as in FIG. 23. The angled deflector tip 614 bears resiliently on the face 486 to aid axial insertion of the finger 610 into the highlight ring 400.

Figure 21:
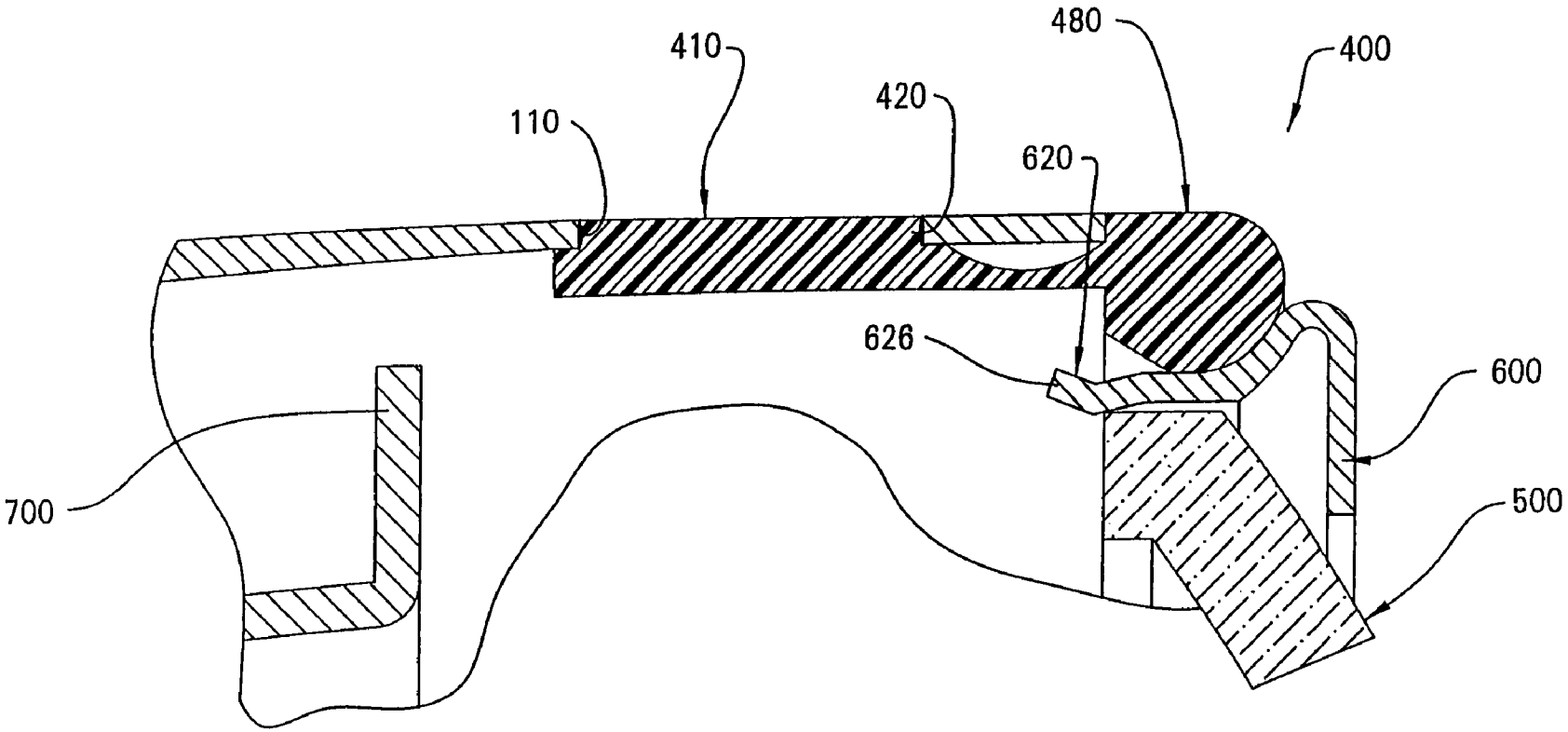
FIG. 21 is an enlarged fragment of FIG. 2.

Plural (here three), evenly circumferentially spaced, leaf-spring-like, lens backing flanges (or clips) 620 (FIG. 20) extend axially inward (rearward) from the skirt 676. Each finger 620 has a front portion 622 extending axially from the skirt 676, a short intermediate step portion 624 angled axially and radially inward therefrom, and a short, deflector tip 626 angled axially inward and radially outward therefrom. As seen in FIG. 21, each finger 620 is sized and shaped to resiliently snap-fit rearwardly over the periphery of the lens 500, the step portion 624 axially inwardly sliding along and being radially outwardly deflected by the perimeter face 524 of the lens, until it reaches and snaps radially inward to oppose the axially inward face 512 of the lens 500. Thus, the lens 500 is resiliently axially clamped between the steps 624 and ribs 680 as in FIGS. 21 and 23.

The thus assembled retainer ring/lens unit is resiliently pressed axially rearward into the annular base 480 of the highlight ring 400 (FIG. 21). The fingers 620 and/or annular base 480 is/are slightly but sufficiently resiliently radially deflectable to allow the finger portions 624 and 626 to pass rearward beyond the annular base 480.

The ribs 680, fingers 410 and fingers 620 are preferably circumferentially spaced from each other.

Thus, the ribs 680 and fingers 620 (FIGS. 21 and 22) radially and axially resiliently clamp the lens 500 within the retaining ring 600. In contrast, the retaining ring fingers 610 resiliently snap into the annular base 480 of the highlight ring 400 to fix the lens 500 thereto.

More specifically, the lens 500 is first resiliently fixed within the retaining ring 600. The assembled unit, comprising the retaining ring 600 and lens 500, is then snap fitted rearward into the highlight ring 400 on the housing 100, so as to cover the front opening into the housing 100. When the retaining ring/lens unit 600, 500 is fully assembled, the fingers 610 press resiliently against the radially inner surface of annular base 480 of the highlight ring 400 to removably fix the retaining ring 600 and lens 500 in the highlight ring 400, with the lens 500 closing the open front end of the housing 100.

In the FIG. 1 embodiment, the lamp is switched "on" or "off" by the switch actuator 310/310A located on the base 300/300A. Switch SW, as mentioned, may include a dimmer that allows the light output of the lamp 10 to be continuously adjusted between 0 and any maximum brightness. The switch SW may be of any conventional type, e.g. toggle, push button, rotary, etc. If desired, the power switch SW may be located off the base 300, e.g. on the housing 100, support shaft 200, power cord, etc.

The housing 100, support shaft 200, base 300, reflector 700 and ring 400 preferably are of metal in the embodiment shown, but could be of other suitable materials, e.g. suitable plastics, noting that the ring 400 must be of springy material. The riser 760 is preferably of suitable insulative material, e.g. plastic or ceramic. The lens 500 and ring 400 are of heat resistant, efficiently light transmitting materials, e.g. tempered glass for the lens 500 and molded transparent plastic for the ring 400. The lens 500 and ring 400 may be clear or colored, in some lamps the same and in others not. Whereas the lens 500 is preferably light diffusing, the ring 400 may or may not be, as desired.

Operation

When switched "on", by the switch actuator 310/310A, light emitter 800 is electrically energized and emits light. The reflector 700 reflects side and back light from the light emitter forward toward the open end of the housing 100 which is physically covered by the light transmitting highlight ring and lens 500. The major light output is forward through the lens 500. However, a portion of the light output refracts through the highlight ring's annular base 480 and protrusions 420 in the housing openings 110. Consequently, light is emitted from the lamp 10 in an aesthetically pleasing, decorative pattern, radially through the protrusions 420 and the openings 110 spaced circumferentially on the peripheral wall 130 of the housing 100, and radially and forwardly through the annular base 480 of the highlight ring 400 at the rim 160 of the housing 100, with the forward light beam passing through the lens 500 fixed by the highlight ring 400 and retaining ring 600 to the housing. The retaining ring 600 also radially separates the lighted lens 500 from the lighted annular base 480 in an aesthetically pleasing manner. Thus, in operation, the observer sees a bright central lens surrounded by a dark, narrow ring, in turn surrounded by a more softly light emitting narrow ring, all spaced forward from a circumferential array of circumferentially spaced, softly light emitting spots of pleasing shape. Moreover, these several light outputs are provided while shielding the user physically from the light emitter 800, which is highly desirable when the latter is a halogen bulb, or a similar hot running, fragile light emitter.

The rings 400 and 600 above described are conveniently circumferentially continuous. However, if desired, either or both could be formed as a split ring, resiliently biased as needed to function as above described.

The lamp 10 may dissipate heat to the surrounding atmosphere. For example, air exchange may take place through the housing vent holes 122 (FIG. 4); reflector vent holes 720 (FIG. 5); the spaces radially between the highlight ring 480 and lens 500 and circumferentially between the retaining ring fingers 610 (FIGS. 21–23), fingers 620 and ribs 680; and, if desired, clearance spaces between the highlight ring fingers 410 and the portions of the housing peripheral wall 130 bounding the window-like through openings 110.

Modification

Figure 24:
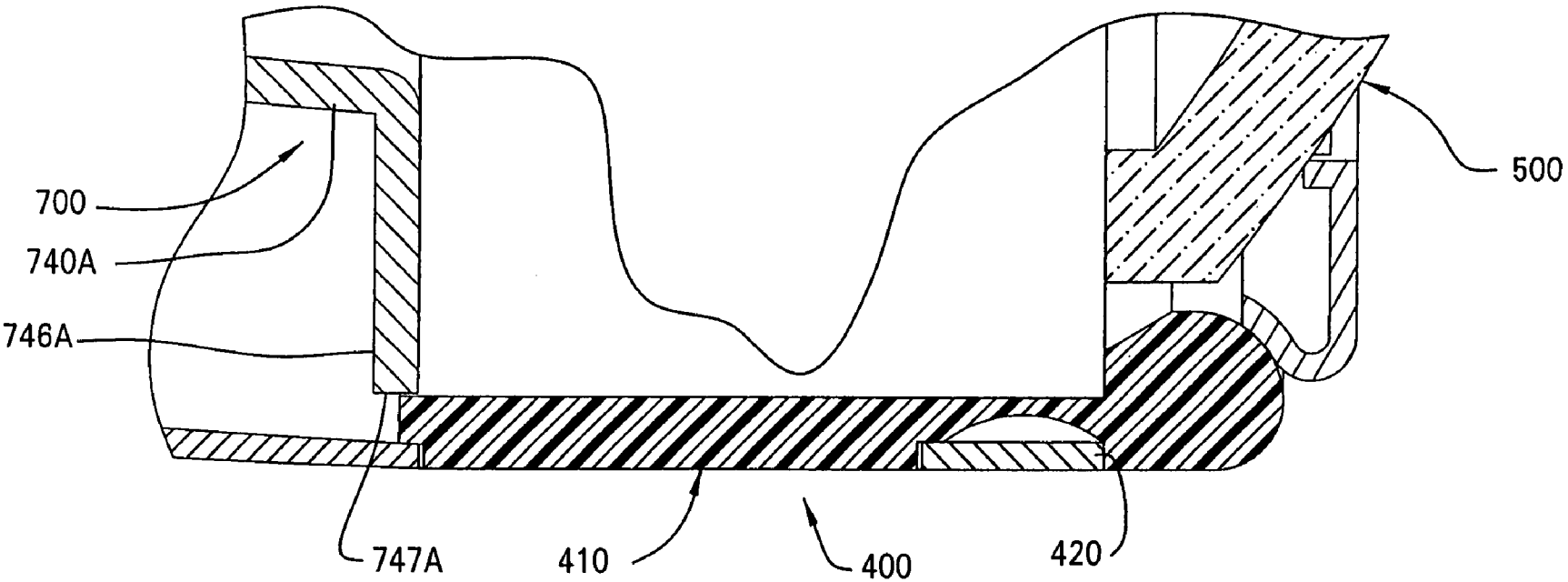
FIG. 24 is a view similar to FIG. 22 but showing a modified reflector.

A modified reflector 700A (FIG. 24) is similar to the reflector 700 (FIG. 7) except as follows. The peripheral wall 740A of the modified reflector 700A extends further forward and its flange 746A extends further radially outward, to locate the outer rim 747A of such flange adjacent the inner ends of the resilient fingers 410 of the highlight ring 400. Thus, for example, if some light striking the back of the lens 500 is reflected rearward toward the reflector flange 746A, the latter tends to reflect it forward again toward the lens, rather than allowing a radially outward portion to pass rearward past the rim of the flange, then rearwardly of the reflector, as might occur with the radially narrower and more rearwardly located flange 746 of FIG. 22.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A lamp comprising:

a housing having a forward end with a first light emitting opening and a peripheral wall;

a light emitter mounting member inside said housing;

a forward light transmitter comprising a lens opposing said light emitter mounting member and said first light emitting opening; and a lateral light transmitter opposing said light emitter mounting member and adjacent said peripheral wall, wherein said lateral light transmitter has a portion that is substantially flush with an outer surface of said peripheral wall.

2. A lamp comprising:

a housing having a forward end with a first light emitting opening and a peripheral wall;

a light emitter mounting member inside said housing;

a forward light transmitter comprising a lens opposing said light emitter mounting member and said first light emitting opening;

a lateral light transmitter opposing said light emitter mounting member and adjacent said peripheral wall; and a retaining member surrounding and fixed to said lens, said lateral light transmitter comprising a light transmitting ring surrounding and fixed to said retaining member, said light transmitting ring being fixed with respect to said housing, wherein said light transmitting ring has a substantially continuous ring-like base carrying circumferentially spaced, light transmitting fingers extending axially into said first light emitting opening and lying snugly against the inner surface of said peripheral wall, said peripheral wall having secondary light emitting openings covered by said light transmitting fingers and thereby providing physically closed but light emitting areas circumferentially spaced on said housing peripheral wall.

3. A lamp according to claim 2 wherein said lens, retaining member, light transmitting ring and housing define concentric light emitting and opaque zones.

4. A lamp according to claim 2 having, as seen from the side, (1) a forward light emitting profile, (2) a plurality of laterally spaced ones of said light emitting areas, and (3) a laterally extending light emitting band axially spaced therebetween, and which are respectively defined by Cl) said lens, (2)said light emitting areas on said peripheral wall and (3) said ring-like base.

5. A lamp comprising:

a light emitter mounting member;

a housing (1) containing said light emitter mounting member and (2)having a primary light emitting opening opposing said light emitter mounting member and (3) having a wall with a secondary light emitting opening;

a light transmitting element fixed with respect to said housing and substantially closing said secondary light emitting opening in light transmitting relation therethrough, said light-transmitting element comprising a substantially continuous ring having a substantially ring-like base and circumferentially spaced resilient fingers extending therefrom and mounted on the front of said housing, wherein said housing has a rim bounding said primary light emitting opening, said ring-like base seating on said rim, a said resilient finger having a resiliently bendable neck carrying a backer in turn carrying a radially outward protrusion, said backer being resiliently biased radially outward, said protrusion being snap fitted in a said secondary light emitting opening in said peripheral wall and therewith fixing said base on said housing.

6. A lamp according to claim 5, wherein said housing has its said primary light emitting opening at the front of the housing, said wall being a peripheral wall with a plurality of said secondary light emitting openings, at least said fingers being light transmitting, said fingers covering said secondary openings, a lens unit covering said primary light emitting opening and fixed with respect to said housing and ring, wherein light from said lamp is transmitted Cl) through said fingers at said secondary light emitting openings, and (2)through said ring, and (3) through said lens unit.

7. A lamp according to claim 6, wherein said lens unit includes a lens, and including light paths from said housing through (1) said fingers, (2) said ring-like base and (3) said lens.

8. A lamp according to claim 5, wherein said substantially ring-like base and resilient fingers are one of translucent and transparent.

9. A lamp comprising:

a light emitter mounting member;

a housing (1) containing said light emitter mounting member and (2)having a primary light emitting opening opposing said light emitter mounting member and (3) having a wall with a secondary light emitting opening;

a light transmitting element fixed with respect to said housing and substantially closing said secondary light emitting opening in light transmitting relation therethrough, said lighttransmitting element comprising a substantially continuous ring having a substantially ring-like base and circumferentially spaced resilient fingers extending therefrom and mounted on the front of said housing, wherein a said finger has a portion that protrudes into a said secondary opening and is substantially flush with an outside surface of said peripheral housing wall.

10. A lamp comprising:

a light emitter mounting member;

a housing (1) containing said light emitter mounting member and (2)having a primary light emitting opening opposing said light emitter mounting member and (3) having a wall with a secondary light emitting opening;

a light transmitting element fixed with respect to said housing and substantially closing said secondary light emitting opening in light transmitting relation therethrough, said lighttransmitting element comprising a substantially continuous ring having a substantially ring-like base and circuferentially spaced resilient fingers extending therefrom and mounted on the front of said housing, wherein a said finger includes a backer that pushes resiliently against an inside surface of said housing peripheral wall to substantially close a said secondary opening.

11. A lamp comprising:

a housing having a rim;

a light transmitting lens;

a substantially ring-like light transmitting member fixed on said housing rim;

a light emitter fixed inside said housing in light transmitting relation with said lens and substantially ring-like like light transmitting member; and a substantially ring-like retainer mounted on said substantially ring-like light transmitting member, said lens being in turn mounted on said substantially ring-like retainer, such that substantially ring-like light transmitting member and retainer in sequence are mountingly interposed between said housing rim and lens.

12. A lamp according to claim 11 wherein said housing has a side wall carrying said rim at a substantially open end thereof, said substantially ring like light transmitting member and retainer comprising respective continuous light transmitting and retaining rings, said lens and rings covering said open end of said housing, said retaining ring extending into said housing.

13. The lamp according to claim 12 in which said light transmitting ring snap fits on said housing and said retaining ring snap fits on said light transmitting ring, and said lens is resiliently fixed on said retaining ring.

14. A lamp according to claim 12, wherein said housing side wall has a plurality of openings, said light transmitting ring including a plurality of resilient light transmitting fingers having portions snap fitted in respective ones of said plurality of openings in light transmitting relation therethrough.

15. A lamp according to claim 12, wherein said retaining ring is opaque and fronts adjacent portions of said lens and light transmitting ring.

16. A lamp according to claim 12, wherein said retaining ring includes axially spaced portions resiliently axially clamping said lens axially therebetween.

17. A lamp according to claim 12, wherein said retaining ring includes circumferentially spaced leaf-spring-like fingers of which some resiliently engage said light transmitting ring and others resiliently engage said lens.

18. A lamp according to claim 12 in which said retaining ring is snap fit removable from said light transmitting ring for replacing said light emitter in said housing.

19. A lamp, comprising:

a light emitter;

a hollow housing containing said light emitter therein and having (1) a primary light emitting opening opposing said light emitter and (2)a wall including a rim bounding said opening and at least one secondary light emitting opening opposing said light emitter;

first, second and third distinct, spaced apart, substantially concentric light paths from said light emitter and out of said housing and comprising (1) a light transmitting lens at said primary light emitting opening, (2)a substantially continuous light transmitting ring-like base surrounding said lens and adjacent said rim, and (3) at least one light transmitting finger at said secondary light emitting opening.

20. A lamp according to claim 19, including an opaque retaining ring connected substantially concentrically between said lens and said light transmitting ring and mounting said lens through said light transmitting ring onto said housing.

21. A lamp according to claim 20 wherein said ring-like base radially overlaps said housing wall rim, a circumferentially spaced plurality of said light transmitting fingers extending resiliently from said ring along the inside surface of said housing wall and substantially filling a corresponding circumferentially spaced plurality of said secondary light emitting openings, said primary light emitting opening being substantially filled by said lens, retaining ring and ring-like base.

22. A lamp according to claim 21, further comprising a lamp base attachable to a support surface, and a support shaft pivotably supporting said housing on said lamp base.

23. A lamp comprising:

a housing containing a light emitter mounting member and having a peripheral wall with an open end, a rim bounding said open end, and light emitting holes in said peripheral wall adjacent said rim;

a ring comprising a ring-like base adjacent said rim and light transmitting fingers extending from said ring-like base, said fingers being located in said housing and into fixed, opposing, light transmitting relation with said holes;

a central light transmitting member having an annular portion received in and fixed with respect to said ring, said central light transmitting member being fixed to said housing through said ring.

24. A lamp according to claim 23 in which said ring is a light transmitting ring molded plastics material and said central light transmitting member is of glass.

25. A lamp according to claim 24 in which said lens substantially spans and closes said open end of said housing, and including a retaining ring operatively interposed between said lens and light transmitting ring with said retaining ring fixing said lens on said light transmitting ring and through said light transmitting ring to said housing.

26. A lamp according to claim 23 in which said central light transmitting member extends forward from said open end of said housing and beyond said light transmitting ring, said central light transmitting member being axially telescoped within said ring-like base of said ring and said rim of said housing.

27. A lamp according to claim 26 in which said fingers are resiliently fixed to said ring-like base and have radially outward protrusions which snap fit in corresponding ones off said holes, said central light transmitting member and said finger protrusions in said holes being visible from the side of the lamp and being in light transmitting relation with a light emitter in said light emitter mounting member.

* * * * *

UNITED STATES PATENT AND TRADEMARK OFFICE

CERTIFICATE OF CORRECTION

PATENT NO. : 7,086,759 B2
APPLICATION NO. : 10/799830
DATED : August 8, 2006
INVENTOR(S) : Richard Hartmann, Jr. et al.

It is certified that error appears in the above-identified patent and that said Letters Patent is hereby corrected as shown below:

Column 8, line 5; change “defined by C1) said” to --defined by (1) said--

Column 8, line 6; change “ (2) said” to -- (2) said--

Column 8, line 11; change “ (2) having” to -- (2) having--

Column 8, line 37; change “transmitted C1) through” to --transmitted (1) through--

Column 8, line 39; change “ (2) through” to -- (2) through--

Column 8, line 50; change “ (2) having” to -- (2) having--

Column 8, line 56; change “lighttransmitting” to --light-transmitting--

Column 8, line 67; change “ (2) having” to -- (2) having--

Column 9, line 6; change “lighttransmitting” to --light-transmitting--

Column 9, line 8; change “circuferentially” to --circumferentially--

Column 9, line 30; change “ring like” to --ring-like--

Column 9, line 62; change “ (2) a wall” to -- (2) a wall--

Column 10, line 6; change “ (2) a” to -- (2) a--

Column 10, line 58; change “ones off said holes” to --ones of said holes--

Signed and Sealed this

Twelfth Day of December, 2006

JON W. DUDAS
*Director of the United States Patent and Trademark Office*